US007065306B2

(12) United States Patent
Akashi et al.

(10) Patent No.: US 7,065,306 B2
(45) Date of Patent: Jun. 20, 2006

(54) TONER RESIDUAL AMOUNT DETECTION APPARATUS

(75) Inventors: Kazukiyo Akashi, Chiba (JP); Yoshio Mizuno, Chiba (JP); Atsushi Chaki, Chiba (JP); Ryo Hanashi, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/165,206

(22) Filed: Jun. 24, 2005

(65) Prior Publication Data

US 2005/0244173 A1 Nov. 3, 2005

Related U.S. Application Data

(62) Division of application No. 10/606,228, filed on Jun. 26, 2003, now Pat. No. 6,931,217.

(30) Foreign Application Priority Data

Jul. 1, 2002 (JP) ..... 2002-192695

(51) Int. Cl.
*G03G 15/08* (2006.01)

(52) U.S. Cl. ..... 399/27; 399/49; 399/30

(58) Field of Classification Search ..... 399/27, 399/29, 30, 49, 58, 59, 60, 61, 62, 258
See application file for complete search history.

(56) References Cited

U.S. PATENT DOCUMENTS 5,450,177 A 9/1995 Oyama
5,790,917 A 8/1998 Takura et al. ..... 399/27
6,456,802 B1 9/2002 Phillips ..... 399/27
6,459,861 B1 10/2002 Sakurai et al. ..... 399/27
6,668,141 B1 12/2003 Kojima et al. ..... 399/27
6,687,467 B1 2/2004 Katoh ..... 399/30

FOREIGN PATENT DOCUMENTS

JP 6-95256 11/1994
JP 8-220865 8/1996
JP 9-127781 5/1997

*Primary Examiner*—Hoang Ngo
(74) *Attorney, Agent, or Firm*—Fitzpatrick, Cella, Harper & Scinto

(57) ABSTRACT

In order to prevent a toner residual amount from being erroneously judged as "toner present" after the toner residual amount has been judged to be insufficient, a toner residual amount detection apparatus includes a developing device for developing an electrostatic image formed on an image bearing member by a toner, the developing device being provided for movement relative to an apparatus main body, a sensor for outputting information corresponding to the toner residual amount in the developing device, a judging device for comparing the output of the sensor with a reference value to thereby judge the toner residual amount, wherein image forming is inhibited via a predetermined number of times of image forming after the toner residual amount is judged to be not sufficient, and a changing device for changing the reference value to a smaller value with the judgement that the toner residual amount is not sufficient.

14 Claims, 6 Drawing Sheets

TONER RESIDUAL AMOUNT DETECTION APPARATUS

CROSS-REFERENCE TO RELATED APPLICATION

This application is a divisional of application Ser. No. 10/606,228, filed Jun. 26, 2003 now U.S. Pat. No. 6,931,217.

BACKGROUND OF THE INVENTION

1. Field of the Invention

This invention relates to a toner residual amount detection apparatus for use, for example, in a copying machine, a printer, a facsimile apparatus or the like for forming an image by the use of an electrophotographic process or an electrostatic recording process.

2. Related Background Art

In an image forming apparatus of the electrophotographic type such as a copying machine or a printer, an electrostatic latent image is formed on the surface of a photosensitive drum as an image bearing member, and the electrostatic latent image on the photosensitive drum is developed and visualized as a toner image by a toner carried on a developing sleeve as the developer carrying member of a developing apparatus. The toner image is then transferred to a transferring material, and the toner image is fixed on the transferring material by a fixing apparatus, and then the transferring material is outputted.

Many of conventional developing apparatuses provided in such image forming apparatuses adopt dry type development using a powder developer. FIG. 6 of the accompanying drawings is a schematic cross-sectional view showing an example of the conventional developing apparatus. This developing apparatus 100 has a rotatable developing sleeve 102 in the opening portion of a developing container 101 containing therein a toner t as a developer which is opposed to a photosensitive drum 107. Also, a rotatable feeding vane 104 for supplying the toner t to the developing sleeve 102 is provided near the developing sleeve 102 in the developing container 101 along the lengthwise direction of the developing sleeve 102.

During a developing operation, the developer carried on the developing sleeve 102 to which a developing bias is applied from a developing bias voltage 103 is carried out to the photosensitive drum 107 side at a developing position to thereby develop and visualize an electrostatic latent image on the photosensitive drum 107. As described above, during the developing operation, the toner t in the developing container 101 is carried out by the developing sleeve 102 and therefore, the toner t in the developing container 101 is decreased.

When the amount of the toner t in the developing container 101 becomes equal to or less than a predetermined level, the amount of the toner t carried out by the developing sleeve 102 is decreased and therefore, there occurs a state in which the quality of an output image is lowered by the occurrence of faulty developing.

Accordingly, to obviate the occurrence of such a state, a notice of a reduction in the toner residual amount for preventing faulty developing and a notice for demanding the supply of the toner t into the developing container 101 need be given when the residual amount level of the toner t has become equal to or less than a certain value, so that the residual amount of the toner t in the developing container 101 may not become equal to or less than a predetermined level. Also, when the notice of the reduction in the toner residual amount in the developing container 101 is ignored and an image forming operation is continued without any toner supply (or replenishment) being effected, it is necessary to further effect the stoppage of the image forming operation in order to prevent faulty developing, or the indication of a notice for demanding toner supply.

Therefore, heretofore, as shown in FIG. 6, an electrically conductive detecting member 105 for detecting the residual amount of the toner t has been provided in the developing container 101 near the developing sleeve 102 along the lengthwise direction of the developing sleeve 102, and a toner residual amount detecting portion 106 has detected the difference between a voltage induced in the detecting member 105 when a developing bias has been applied from a developing bias voltage source 103 to the developing sleeve 102 (hereinafter referred to as the antenna voltage) and a predetermined voltage value stored in the toner residual amount detecting portion 106 (i.e., a voltage value at which the residual amount level state of the toner t in the developing container 101 is a level at which "notice and replenishment are demanded", and hereinafter referred to as the reference voltage), and from the result of this detection, the residual amount level state of the toner t in the developing container 101 has been detected.

That is, whether the residual amount level state of the toner t in the developing container 101 has lowered to the "notice and replenishment" level or not is detected by a change in the electrostatic capacity of a capacitor having the developing sleeve 102 and the detecting member 105 as pole plates.

Now, in the detection of the residual amount level state of the toner t in the developing container 101 in the above-described conventional developing apparatus 100, it is known that it can be reliably detected that the residual amount level state of the toner t in the developing container 101 has lowered to the level at which notice and replenishment are demanded, but as to whether the supply of the toner t has been done after this detection, erroneous detection is liable to occur.

As one of the causes of this erroneous detection, mention may be made of a change in the toner distribution (density) between the developing sleeve 102 and the detecting member 105. For example, when a transferring material is jammed during the image forming operation after the toner residual amount detecting portion 106 has lowered to the "notice and replenishment" level, if the developing apparatus 100 is dismounted from the image forming apparatus to effect the treatment thereof (hereinafter referred to as the jam treatment), the toner distribution between the developing sleeve 102 and the detecting member 105 as shown in FIG. 7A of the accompanying drawings will be destroyed by the vibration due to the shock or the like of the dismounting, as shown in FIG. 7B of the accompanying drawings, and the electrostatic capacity will be changed.

As a result, during the recovery or image forming after the jam treatment, a portion by which the antenna voltage exceeds the reference voltage will increase from the state of FIG. 8A of the accompanying drawings before the developing apparatus 100 is dismounted from the image forming apparatus, as shown in FIG. 8B of the accompanying drawings, and there will occur the phenomenon that in spite of the toner supply being not effected, the "notice and replenishment" display indicated on the panel of an operation portion (not shown) is turned off.

When such a phenomenon occurs immediately before the stoppage of the image forming operation, if the image forming operation is again continued after the above-mentioned "notice and replenishment" display, if an image having a high image percentage is to be formed, the supply of the toner t to the developing sleeve 102 has not been performed in time, and there has occurred the phenomenon that the formed image has a white blank area (hereinafter referred to as the blank image).

Also, in the above-described conventional toner residual amount detecting construction, when the surroundings of the developing apparatus have risen in temperature due to the heat generation in the image forming apparatus, there has been a case where similar erroneous detection occurs.

To avoid the phenomenon as described above, there becomes necessary the construction of an image forming apparatus which permits jam treatment to be effected without the developing apparatus being detached from the image forming apparatus, or an agitating mechanism or the like for uniformizing the toner distribution in the developing container after the developing apparatus is detached from the image forming apparatus and therefore, the image forming apparatus will suffer from a great increase in cost, complication and bulkiness, and this has hindered space saving and a lower cost.

SUMMARY OF THE INVENTION

The present invention has as an object thereof to provide a toner residual amount detection apparatus which can completely prevent from being judged as "toner present" after a toner residual amount has been judged to be insufficient.

Further objects of the present invention will become apparent from the following detailed description when read with reference to the accompanying drawings.

DETAILED DESCRIPTION OF THE PREFERRED EMBODIMENTS

Figure 1:
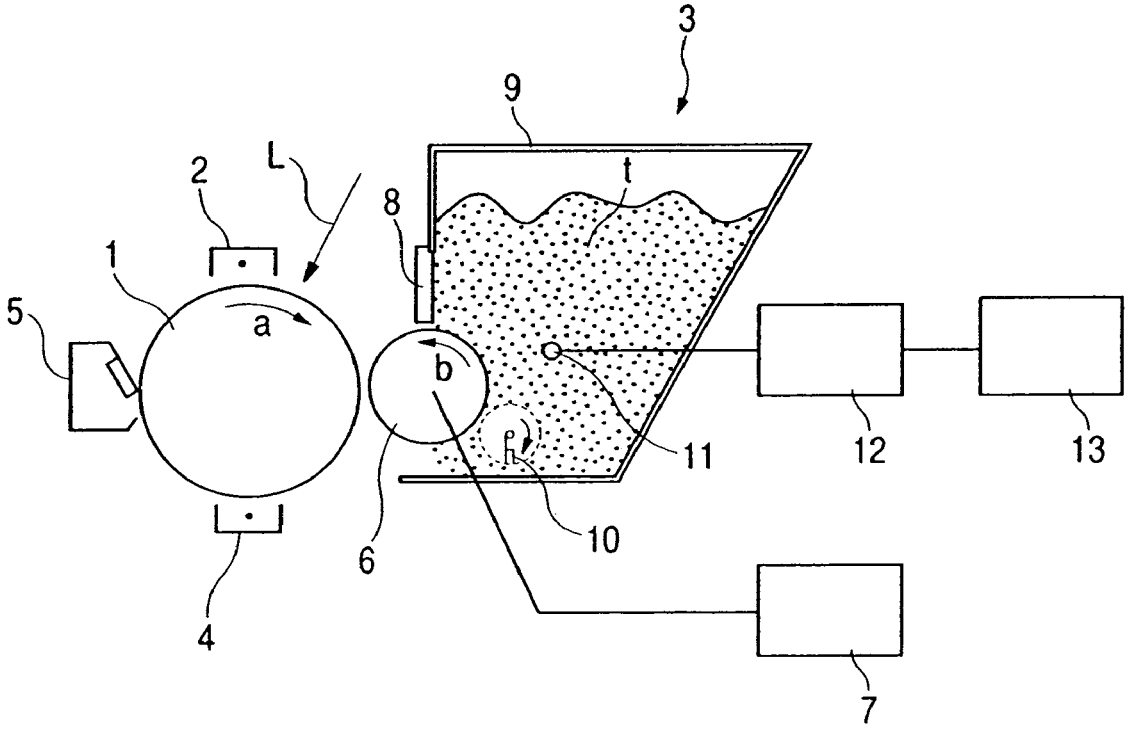
FIG. 1 shows an image forming apparatus provided with a developing apparatus according to Embodiment 1 or 2 of the present invention.

The present invention will hereinafter be described with respect to some embodiments thereof shown in the drawings.

Embodiment 1

FIG. 1 schematically shows the construction of an image forming apparatus provided with a developing apparatus according to Embodiment 1 of the present invention.

This image forming apparatus is provided with a primary charger 2, a developing apparatus 3, a transferring charger 4 and a cleaning apparatus 5 around a photosensitive drum 1 as an image bearing member, and transfers to a transferring material a toner image formed on the photosensitive drum 1 by an electrophotographic image forming process to thereby effect image forming.

More particularly, image exposure L is provided by an exposing apparatus (not shown) onto the photosensitive drum 1 charged by the primary charger 2 and being rotated at a predetermined process speed in the direction of arrow a (clockwise direction), and the potential of that portion of the surface of the photosensitive drum 1 which has been provided with the image exposure L is lowered, and an electrostatic latent image conforming to inputted image information is formed. Then, a toner (developer) charged to the same polarity as the charging polarity of the photosensitive drum 1 is caused to adhere to the electrostatic latent image by a developing sleeve 6 as the developer carrying member of the developing apparatus 3 to which a developing bias of the same polarity as the charging polarity of the photosensitive drum 1 is applied from a developing bias voltage source 7, thereby visualizing the electrostatic latent image as a toner image.

When the toner image formed on the photosensitive drum 1 arrives at the transferring nip portion between the photosensitive drum 1 and the transferring charger 4, a transferring material such as paper is fed to the transferring nip portion in timed relationship therewith, and by the transferring charger 4 to which a transferring bias opposite in polarity to the toner is applied, the toner image on the photosensitive drum 1 is transferred to the transferring material with the aid of an electrostatic force produced between the photosensitive drum 1 and the transferring charger 4.

The transferring material to which the toner image has been transferred is then separated from the photosensitive drum 1 and is conveyed to a fixing apparatus (not shown), and the toner image is heated and pressurized by the fixing nip between a fixing roller and a pressure roller, not shown, and is thereby fixed on the transferring material, whereafter the transferring material is outputted to the outside. Also, any untransferred toner residual on the photosensitive drum 1 after the above-described transfer is removed and collected by the cleaning apparatus 5.

The details of the developing apparatus 3 in the present embodiment will now be described.

The developing apparatus 3 has the developing sleeve 6 as a rotatable toner carrying member disposed in proximity to the photosensitive drum 1, the developing bias voltage source 7 for applying a developing bias (a bias comprising an AC component superimposed on a DC component) to the developing sleeve, a layer thickness regulating blade 8 for regulating the layer thickness of the toner and coating the surface of the developing sleeve 6 with the toner, a developing container 9 containing the toner t therein, a feeding vane 10 for supplying the toner t to the developing sleeve 7, and an electrically conductive detecting member 11 as a sensor for detecting the residual amount of the toner t in the developing container 9.

Also, the developing apparatus 3, together with the contained toner therein, is made into a cartridge integrally with the photosensitive drum 1, the primary charger 2 and the cleaning apparatus 5, and is designed to be detachably attachable to the image forming apparatus. An operator can easily effect jam treatment by utilizing a space in the image forming apparatus from which the thus constructed cartridge has been detached and this is useful to improve usability.

It is not requisite to thus make the developing apparatus into a cartridge, but the developing apparatus 3 can adopt such a construction that the distribution of the toner in the developing apparatus 3 can change, and at least the developing apparatus 3 can be of a construction in which it is movable relative to the main body of the image forming apparatus. For example, even when in a construction wherein the image forming apparatus comprises an upper housing and a lower housing, and the upper housing is opened and closed relative to the lower housing (in this case, the lower housing becomes the main body of the image forming apparatus), the developing apparatus 3 is provided in the upper housing, the present invention is effective.

The detecting member 11 is provided in the developing container 9 near the developing sleeve 6 along the lengthwise direction of the developing sleeve 6. A rectifying and amplifying portion 12 and a toner residual amount detecting portion 13 are connected to the detecting member 11, and the toner residual amount detecting portion 13 effects the detection of the toner residual amount in the developing container 9 (the details of the toner residual amount detection which is a feature of the present invention will be described later).

The developing sleeve 6 is rotatively driven in the direction of arrow b (counterclockwise direction), and charges are imparted to the toner t by the contact friction among the particles of the toner tin the developing container 9, the contact friction between the toner t and the surface of the developing sleeve 6, etc., and the toner t is carried on the surface of the developing sleeve 6 to thereby form a toner layer.

The toner t carried on the surface of the developing sleeve 6 is further subjected to friction by the layer thickness regulating blade 8 and has charges imparted thereto and at the same time, is regulated so that the toner layer may become a thin layer. Thereafter, the toner t on the surface of the developing sleeve 6 is carried to a developing area (developing portion) formed by the photosensitive drum 1 and the developing sleeve 6, by the rotation of the developing sleeve 6.

In this developing area, the toner t flies by the action of an electric field produced by the application of a developing bias from the developing bias voltage source 7 to the developing sleeve 6, whereby the electrostatic latent image on the photosensitive drum 1 is developed (reversal-developed) and visualized.

The procedure of detecting the toner residual amount in the developing container 9 in the present embodiment will now be described with reference to a flowchart shown in FIG. 2.

When the power source switch of the above-described image forming apparatus is closed and an image forming start (copy ON) signal is inputted thereto during its waiting state (steps S1 and S2), the image forming (copy/print) operation is started. When a developing bias (a bias comprising an AC component superimposed on a DC component) is applied from the developing bias voltage source 7 to the developing sleeve 6 of the developing apparatus 3 (step S3), a voltage (antenna voltage) is induced in the detecting member 11, and the detection of the toner residual amount is started.

Figure 3A:
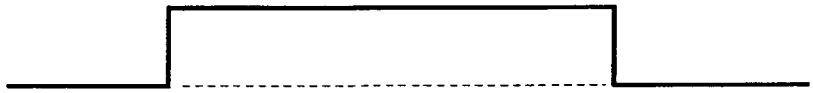
FIGS. 3A, 3B and 3C are timing charts for illustrating the toner residual amount detecting procedure in Embodiment 1 of the present invention.
Figure 3B:
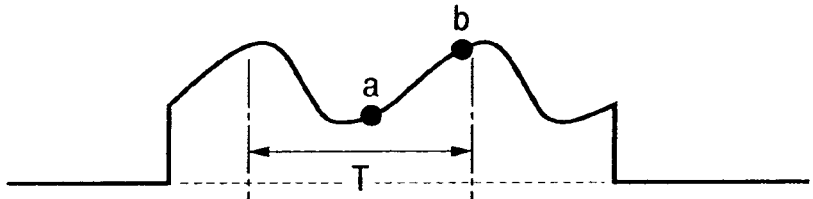
Figure 3C:
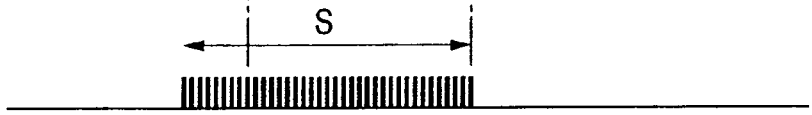

FIGS. 3A to 3C are timing charts in the toner residual amount detection in the present embodiment, FIG. 3A shows the application timing signal of the developing bias applied to the developing sleeve 6, FIG. 3B shows an antenna voltage signal induced in the detecting member 11, and FIG. 3C shows a sampling timing signal representative of a toner residual amount detection time S and timing for sampling.

As is apparent from the timing charts shows in FIGS. 3A to 3C, the antenna voltage is fluctuated by a period T. This is substantially coincident with the rotation period of the feeding vane 10 for supplying the toner t to the developing sleeve 6. This will hereinafter be described in greater detail.

Figure 4A:
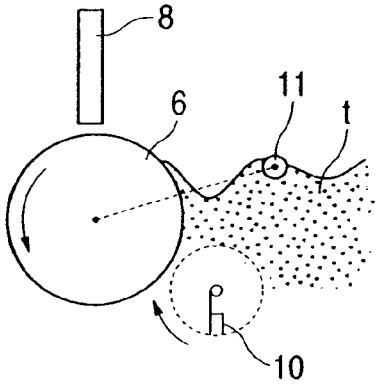
FIGS. 4A and 4B are views for illustrating a change in the toner distribution (density) in the developing container by the rotation of a feeding vane.
Figure 4B:
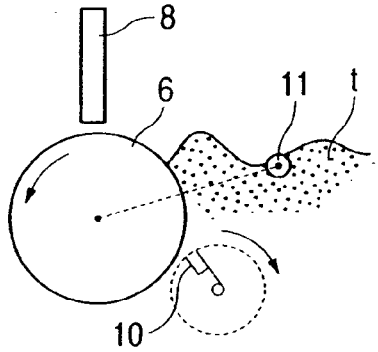

FIGS. 4A and 4B show the manner in which the toner distribution (density) in the developing container 9 is changed by the rotation of the feeding vane 10, FIG. 4A shows the toner distribution (density) in the developing container 9 when the feeding vane 10 is facing downward, and FIG. 4B shows the toner distribution (density) in the developing container 9 when the feeding vane 10 has been rotated by 120° from the state of FIG. 4A. As shown in FIG. 4A (FIG. 4B), it will be seen that when the center of rotation of the developing sleeve 6 and the center of the detecting member 11 are linked together by a straight line, the amount of the toner t present on that line apparently differs, and the antenna signal in the case of FIG. 4A corresponds to a point a in FIG. 3B, and the antenna signal in the case of FIG. 4B corresponds to a point b in FIG. 3B.

In the toner residual amount detection, when for example, the toner residual amount detection time S shown in FIG. 3C is made extremely short and the toner residual amount detection is set so as to be effected at the point a in FIG. 3B, there is a case where in spite of the toner amount in the developing container 9 being the same amount, a signal equal to that when toner supply has been done, i.e., a signal like the point b in FIG. 3B, comes to the next toner residual amount detection, and this has become a great factor which brings about erroneous detection.

Therefore, in order to suppress the influence of the rotation of the feeding vane 10, it is desirable that the rotation period T of the feeding vane 10 and the toner residual amount detection time S be $S \cong T$. So, in the present embodiment, the rotation period T of the feeding vane 10 has been 1.8 sec. and the toner residual amount detection time S has been 2.0 sec.

For this detection time S, the sampling of the antenna voltage is effected 100 times (step S4), the antenna voltage is compared with a pre-given reference voltage (4.0V in the present embodiment) stored in the toner residual amount detecting portion 13 (step S5), and when the antenna voltage is greater than the reference voltage, it is judged as "toner present", and when the antenna voltage is smaller than the reference voltage, it is judged as "toner absent" (steps S6 and S7). The antenna voltage induced in the detecting member 11 is rectified and amplified by the rectifying and amplifying portion 12 and is inputted to the toner residual amount detecting portion 13.

If at the step S6, "toner present" is judged, the sampling of the antenna voltage is terminated (step S8), and if at the step S7, "toner absent" is judged, "toner absent" detection is executed a predetermined number of times (N=N+1) (Step S9).

According to our studies, it has been found that if the number of times N of the "toner absent" detection is small, the toner residual amount detection is liable to be subjected to the influence of the toner distribution (density) in the developing container 9, i.e., the influence of the amount of moisture content in the atmosphere and the above-described rotation period of the feeding vane 10, and the detection of a predetermined toner residual amount cannot be accomplished, and to detect the toner residual amount accurately, detection of 70% or greater is necessary for at least N≧70, i.e., the number of times of sampling (100 times).

So, in the present embodiment, the number of times N' of the "toner absent" detection as a reference value has been set to 80 times, that is, toner residual amount detection has been effected with the "toner absent" detection equal to or greater than 80% of the number of times of sampling (N≧N')(Step S10). Then, during this detection, the toner amount in the developing container 9 is judged to have reached a predetermined value, and by a signal from the toner residual amount detecting portion 13, "notice and replenishment" indicating that the toner residual amount in the developing apparatus is insufficient" is displayed on the panel of the operation portion (not shown) of the image forming apparatus (step S12). Also, if at the step S10, the result of the detection is not N≧N' the image forming operation (copying operation) is terminated (step S11).

The above-described "display" construction is not restrictive, but the present invention is also effective in the case of a construction in which for example, a notice is given through a network to a user by an external apparatus such as a personal computer network-connected to the image forming apparatus.

Also, the toner residual amount detecting portion 13 counts the number of times of image forming effected after it has been judged that "the toner residual amount in the developing apparatus is insufficient", that is, after the display of "notice and replenishment", i.e., the number of sheets having images formed thereon, and outputs a signal to a controlling portion so as to stop the image forming operation when this reaches a predetermined number of sheets (100 sheets in the present embodiment), and also outputs a signal so as to display "toner supply necessary" (cartridge interchange necessary) on the panel of a liquid crystal operation portion.

When toner residual amount detection was effected under the above-described control, highly accurate toner residual amount detection could be accomplished without being affected by the environment, the rotation period of the feeding vane 10, etc.

Now, when after the display of "notice and replenishment" at the step S12, an attempt was made to cause the jam of a recording material for example, to the ninetieth one of 100 sheets being continuously image-outputted, and detach the developing apparatus 3 (cartridge) and effect jam treatment, the display of "notice and replenishment" was turned off in spite of toner supply being not effected (in spite of the cartridge being not interchanged to a new one). When from this state, continuous image outputting of 100 sheets was further effected, there occurred the problem that white blanks occurred to images on the sixtieth and subsequent sheets due to the deficiency of the toner and the characters of the images became unreadable.

This means that the toner amount in the developing container 9 was detected at a predetermined residual amount by the toner residual amount detection before the display of "notice and replenishment", but as described above, the developing apparatus 3 was detached in case of jam treatment and therefore, the distribution (density) of the toner in the developing container 9 was changed, that is, the electrostatic capacity between the developing sleeve 6 and the detecting member 11 was changed, and the condition of "toner absent" of the above-mentioned detection sampling 80% came to be not satisfied, and the display of "notice and replenishment" was turned off.

Also, the second toner residual amount detection during the image forming operation after the above-described jam treatment is effected in a state the toner amount in the developing container 9 has been further decreased and therefore, the images had become blank images before the display of "toner supply necessary" was done.

Figure 2:
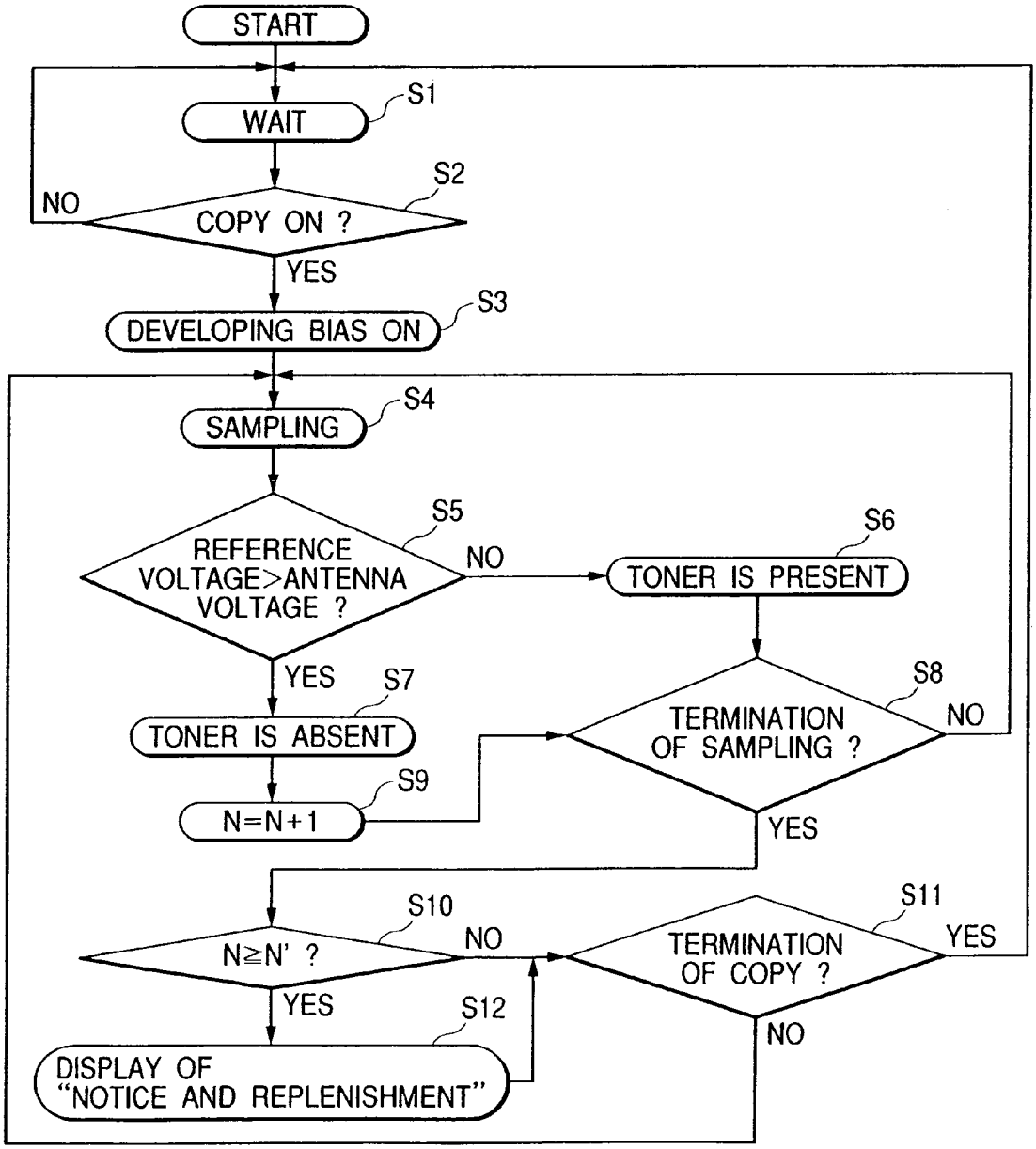
FIG. 2 is a flowchart showing the procedure of detecting a toner residual amount in a developing container in Embodiment 1 of the present invention.

So, in the present embodiment, in order that the display of "notice and replenishment" might be done again in the toner residual detection even under such a situation, the number of times of "toner absent" detection relative to the number of times of sampling of the antenna voltage was made lower than the toner residual amount detection before the display of "notice and replenishment" in FIG. 2.

The procedure of detecting the toner residual amount in the developing container 9 in this case will now be described with reference to a flowchart shown in FIG. 5.

Figure 5:
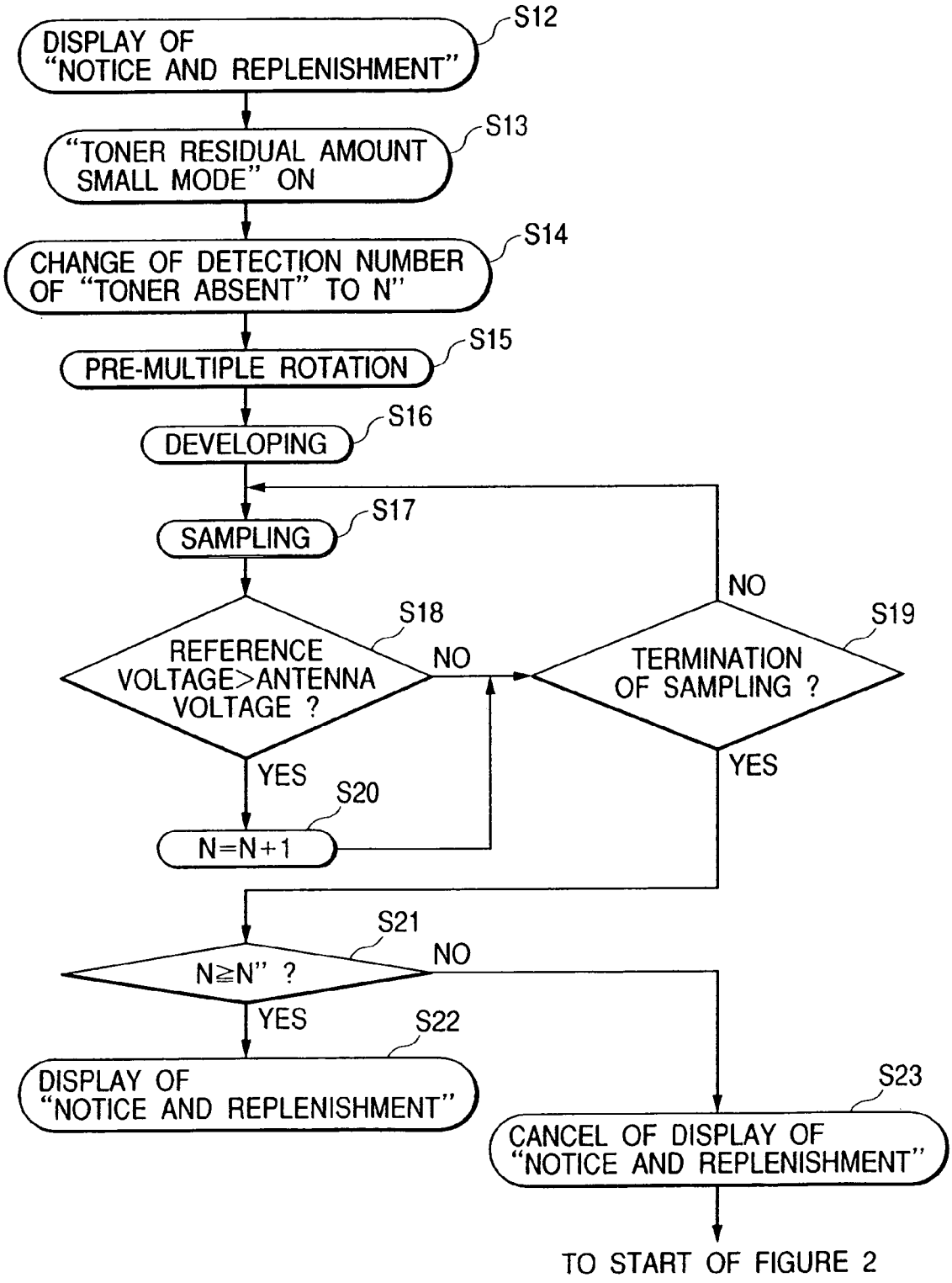
FIG. 5 is a flowchart showing the "toner residual amount small mode" of the toner residual amount detecting procedure in the developing container in Embodiment 1 of the present invention.
Figure 6:
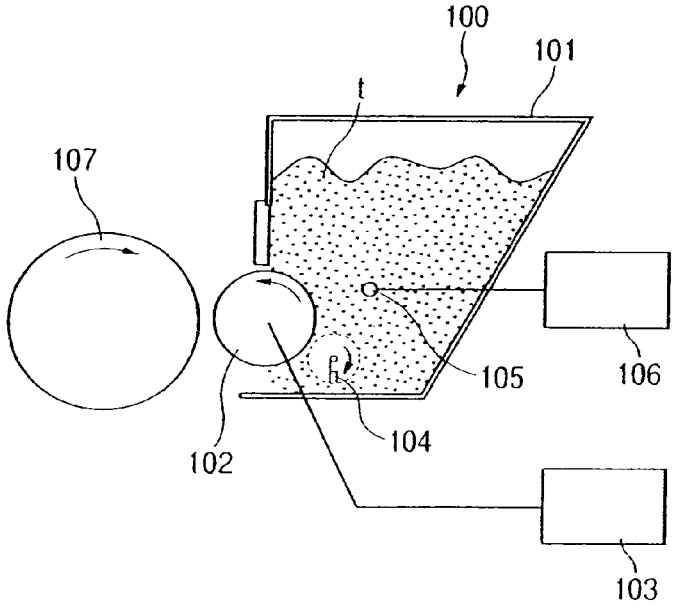
FIG. 6 PRIOR ART
FIG. 6 shows a developing apparatus in an example of the prior art.

If at step S12, "notice and replenishment" is displayed when the toner residual amount is small by the toner residual amount detection shown in FIG. 2, a "toner residual amount small mode" is turned on as shown in FIG. 5 (step S13), and the number of times N' (N'=80 times) of detection of "toner absent" as a reference value is changed to N" (N"0=30 times in the present embodiment) smaller than that value (step S14).

During the pre-multiple rotation of the photosensitive drum 1 effected in jam treatment or the like, a developing bias (a bias comprising an AC component superimposed on a DC component) is applied from the developing bias voltage source 7 to the developing sleeve 6 (step S16), whereby a voltage is induced in the detecting member 11, and toner residual amount detection is started. Then, in the same manner as described above, the sampling of the antenna voltage is effected 100 times (step S17), and the antenna voltage is compared with a pre-given reference voltage 4.0V in the present embodiment) stored in the toner residual amount detecting portion 13 (step S18).

If as the result of this comparison, the antenna voltage is greater than the reference voltage, the sampling of the antenna voltage is terminated (step S19), and if the antenna voltage is smaller than the reference voltage, "toner absent" detection is executed a predetermined number of times (N=N+1) (Step S20).

Then, after the termination of the sampling of the antenna voltage at the step S19, the number of times N of "toner absent" detection is compared with the above-mentioned N" (step S21), and if N≦N", "notice and replenishment" is displayed on the panel of the operation portion (not shown) of the image forming apparatus by a signal from the toner residual amount detecting portion 13 (step S22). Also, if at the step S21, the result of the comparison is not N≦N", it is regarded as "toner supply" having been done into the developing container 9 (regarded as the cartridge having been interchanged to a cartridge sufficiently containing the toner therein), and the display of "notice and replenishment" is cancelled to thereby bring about an ordinary image forming standby state (step S23), and return is made to the start of the flowchart of FIG. 2.

Figure 7A:
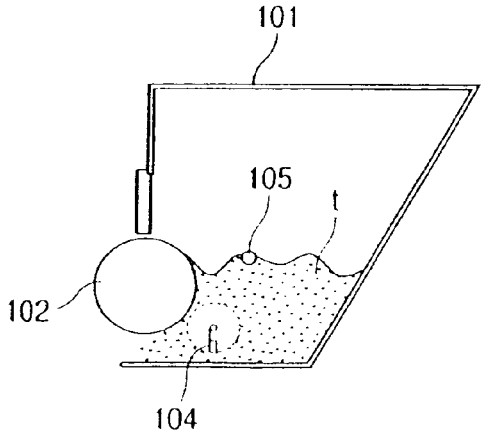
FIGS. 7A and 7B show the toner distribution (density) in a developing container before and after a developing apparatus is dismounted after the "notice and replenishment" display by toner residual amount detection.
Figure 7B:
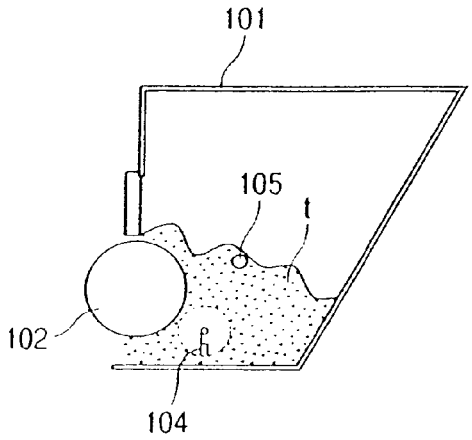
Figure 8A:
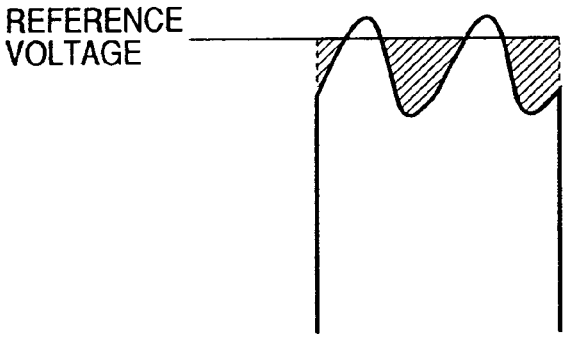
FIGS. 8A and 8B show an antenna voltage before and after the developing apparatus is dismounted after the "notice and replenishment" display by the toner residual amount detection.
Figure 8B:
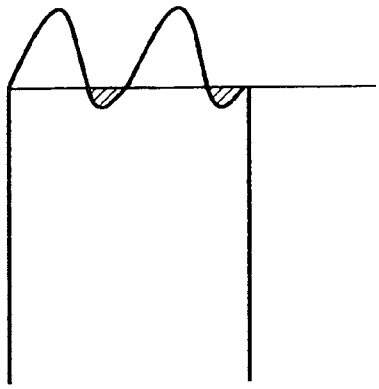

As described above, in the case of the toner residual amount small mode, the number of times N' of detection of "toner absent" is changed to N" which is a value smaller than the value of N', whereby even if in spite of the toner amount having not been changed, the toner distribution in the developing container is destroyed for some reason or other as shown in FIG. 7B, the toner residual amount can be completely provided from being judged as "toner present" by mistake after the termination of the sampling of the antenna voltage, and the occurrence of a faulty image such as the above-described white blank can be prevented.

On the other hand, to exceed the number of times N" of detection of "toner absent", the toner amount in the developing container must be increased by replenishment (by the interchange of the cartridge) and therefore, at that time, it may be judged that toner supply has been done reliably. Consequently, if the number of times N" of detection of "toner absent" is exceeded during the toner residual amount small mode, the number of times of detection of "toner absent" which is the reference is restored to N" and also the display of "notice and replenishment" is cancelled.

That is, in the present embodiment, a design is made such that the toner residual amount small mode is maintained until in spite of the developing apparatus 3 having been detached for jam treatment or the like (though the cartridge might be interchanged to a new one), it is judged by the sampling output from the detecting member that the toner residual amount is sufficient.

As described above, by the toner residual amount detection in the present embodiment being effected, even when the toner amount in the developing container 9 has been detected at a predetermined residual amount by the toner residual amount detection before the display of "notice and replenishment", but the distribution (density) of the toner in the developing container 9 has been changed because of the developing apparatus 3 having been detached for jam treatment or the like, highly reliable toner residual amount detection can be effected and also, whether toner supply has been done reliably can be detected without causing any increase in cost and the bulkiness and constructional complication of the image forming apparatus and therefore, good images can be obtained stably for a long period.

While in the above-described embodiment, for the sake of convenience of description, the number of times of sampling output indicative of "toner absent" within a predetermined time has been described as an example, "toner present" and "toner absent" are the two sides of one thing and therefore, description based on the number of times of sampling output indicative of "toner present" can be considered to be the converse of the foregoing description based on "toner absent" and therefore need not be made.

Embodiment 2

Again in this embodiment, a description will be made of an image forming apparatus provided with the developing apparatus of Embodiment 1 shown in FIG. 1. The present embodiment is similar to Embodiment 1 except for the detection of the toner residual amount in the developing container, and in the present embodiment, a description will be made of only the detection of the toner residual amount in the developing container in the present embodiment.

First, in the same manner as previously described, the sampling of the antenna voltage induced in the detecting member 11 is effected, and the antenna voltage is compared with the pre-given reference voltage stored in the toner residual amount detecting portion 13, and if the peak value of the antenna voltage is greater than the peak value of the reference voltage, it is judged as "toner present", and if the peak value of the antenna voltage is smaller than the peak value of the reference voltage, it is judged as "toner absent".

In the present embodiment, a design is made such that the sum total of the "toner absent" detection time is found and the sum total of the "toner absent" detection time is compared with the toner residual amount detection time S, and depending on the percentage(%) at which the sum total of the "toner absent" detection time occupies in the toner residual amount detection time S, the ordinary toner residual amount detection basically similar to that in Embodiment 1 and the toner residual amount detection in the "toner residual amount small mode" are effected.

According to out studies, it has been found that if the percentage(%) at which the sum total of "toner absent" detection time occupies in the toner residual amount detection time S is less than 70%, detection at a predetermined toner residual amount is impossible, and that if the percentage(%) is greater than 50%, erroneous detection is caused to the toner residual amount detection by a change in the distribution (density) of the toner in the developing container 9.

So, in the present embodiment, if the toner residual amount detection time S is 2.0 sec. And the percentage at which the sum total of the "toner absent" detection time by the first toner residual amount detection occupies in the toner residual amount detection time is 80%, that is, if "toner absent" is detected for 1.6 sec. or longer, it is judged that the toner amount in the developing container 9 has reached a predetermined value, and by a signal from the toner residual amount detecting portion 13, "notice and replenishment" is displayed on the panel of the operation portion (not shown) of the image forming apparatus.

Then, when after the display of "notice and replenishment" by the above-described toner residual amount detection, the "toner residual amount small mode" is turned on, if the percentage(%) at which the sum total of the "total absent" detection time by this toner residual amount detection occupies in the toner residual amount detection time is 30%, that is, if "toner absent" is detected for 0.6 sec. or longer, "notice and replenishment" is displayed on the panel of the operation portion (not shown) of the image forming apparatus by a signal from the toner residual amount detecting portion 13.

Thus, in the toner residual amount detection in the present embodiment, an effect similar to that of Embodiment 1 can be obtained by a simpler control than the toner residual amount detection is Embodiment 1.

As described above, according to each of the above-described embodiments, after the toner residual amount has been judged to be insufficient, the toner residual amount can be completely prevented from being judged as "toner present" by mistake because of the toner distribution in the developing device having changed with the movement of the developing device such as the attachment or detachment thereof, in spite of the toner residual amount having not been changed. Thus, there can be provided a highly reliable toner residual amount detection apparatus which can realize this without causing any increase in cost and the bulkiness and complication of the apparatus. Accordingly, good images can be obtained stably for a long period.

The invention claimed is:

1. A toner residual amount detection apparatus comprising:

a developing device for developing an electrostatic image formed on an image bearing member by a toner, said developing device being provided on and movable with respect to an apparatus main body;

toner residual amount detection means for detecting an amount of residual toner in said developing device, said toner residual amount detection means performing a detection operation at predetermined frequencies in a predetermined period;

counting means for determining whether each of detection results obtained from said toner residual amount detection means is less than a predetermined toner residual amount value and counting a number of times which is determined that the detection result is less than the predetermined toner residual amount value;

control means for, in a case where the number of times counted by said counting means exceeds a reference number of times, determining and displaying that the toner residual amount is insufficient, and for, in a case where a number of times of image forming operation performed after said displaying is equal to or greater than a predetermined number of times, inhibiting the image forming operation; and change means for changing the reference number of times to a smaller value in a case where the toner residual amount is insufficient.

2. A toner residual amount detection apparatus according to claim 1, wherein said developing device is provided detachably from the apparatus main body.

3. A toner residual amount detection apparatus according to claim 2, wherein a toner detection member provided in said toner residual amount detection means is provided in said developing device.

4. A toner residual amount detection apparatus according to claim 3, wherein said toner detection member includes an electrically conductive member disposed in opposed relationship with a toner carrying member provided in said developing device for outputting a signal conforming to the toner residual amount with application of a developing bias to said toner carrying member.

5. A toner residual amount detection apparatus according to claim 1, wherein a toner detection member provided in said toner residual amount detection means is provided in said developing device.

6. A toner residual amount detection apparatus according to claim 5, wherein said toner detection member includes an electrically conductive member disposed in opposed relationship with a toner carrying member provided in said developing device for outputting a signal conforming to the toner residual amount with application of a developing bias to said toner carrying member.

7. A toner residual amount detection apparatus according to claim 1, wherein said toner residual amount detection means performs the detection operation at the predetermined frequencies in the predetermined period again after it is determined that the toner residual amount is insufficient, wherein said counting means determines whether each of the detection results obtained from said toner residual amount detection means is less than the predetermined toner residual amount value and counts the number of times which is determined that the detection result is less than the predetermined toner residual amount value, and wherein said change means changes the smaller value to the reference number of times in a case where the number of times counted by said counting means is less than the smaller value.

8. A toner residual amount detection apparatus comprising:

a developing device for developing an electrostatic image formed on an image bearing member by a toner, said developing device being provided on and movable with respect to an apparatus main body;

toner residual amount detection means for detecting an amount of residual toner in said developing device, said toner residual amount detection means performing a detection operation during a predetermined period;

calculation means for accumulating a period in which a detection result obtained from said toner residual amount detection means is less than a predetermined toner residual amount value, and calculating a ratio value of the accumulated period to the predetermined period;

control means for, in a case where the ratio value calculated by said calculation means exceeds a reference ratio value, determining and displaying that the toner residual amount is insufficient, and for, in a case where a number of times of image forming operation performed after said displaying reaches a predetermined number of times, inhibiting the image forming operation; and change means for changing the reference ratio value to a smaller value in a case where the toner residual amount is insufficient.

9. A toner residual amount detection apparatus according to claim 8, wherein said developing device is provided detachably from the apparatus main body.

10. A toner residual amount detection apparatus according to claim 9, wherein a toner detection member provided in said toner residual amount detection means is provided in said developing device.

11. A toner residual amount detection apparatus according to claim 10, wherein said toner detection member includes an electrically conductive member disposed in opposed relationship with a toner carrying member provided in said developing device for outputting a signal conforming to the toner residual amount with application of a developing bias to said toner carrying member.

12. A toner residual amount detection apparatus according to claim 8, wherein a toner detection member provided in said toner residual amount detection means is provided in said developing device.

13. A toner residual amount detection apparatus according to claim 12, wherein said toner detection member includes an electrically conductive member disposed in opposed relationship with a toner carrying member provided in said developing device for outputting a signal conforming to the toner residual amount with application of a developing bias to said toner carrying member.

14. A toner residual amount detection apparatus according to claim 8, wherein said toner residual amount detection means performs the detection operation during the predetermined period again after it is determined that the toner residual amount is insufficient, wherein said calculation means accumulates the period in which the detection result obtained from said toner residual amount detection means is less than the predetermined toner residual amount value, and calculating a ratio value of the accumulated period to the predetermined period, and wherein said change means changes the smaller value to the reference ratio value in a case where the ratio value calculated by said calculation means is less than the smaller value.

* * * * *

UNITED STATES PATENT AND TRADEMARK OFFICE

CERTIFICATE OF CORRECTION

PATENT NO. : 7,065,306 B2
APPLICATION NO. : 11/165206
DATED : June 20, 2006
INVENTOR(S) : Kazukiyo Akashi et al.

It is certified that error appears in the above-identified patent and that said Letters Patent is hereby corrected as shown below:

COLUMN 5:
Line 39, "toner tin" should read --toner t in--.

COLUMN 12:
Line 58, "calculat-" should read --calculates--.
Line 59, "ing" should be deleted.

Signed and Sealed this

Second Day of January, 2007

JON W. DUDAS
*Director of the United States Patent and Trademark Office*